US008322549B2

(12) United States Patent
Bourque et al.

(10) Patent No.: US 8,322,549 B2
(45) Date of Patent: Dec. 4, 2012

(54) TWIST OFF CROWN

(75) Inventors: Robert H Bourque, Crawfordsville, IN (US); William E Perkins, Crawfordsville, IN (US)

(73) Assignee: Crown Packaging Technology, Inc., Alsip, IL (US)

( * ) Notice: Subject to any disclaimer, the term of this patent is extended or adjusted under 35 U.S.C. 154(b) by 1255 days.

(21) Appl. No.: 12/107,458

(22) Filed: Apr. 22, 2008

(65) Prior Publication Data

US 2009/0261056 A1 Oct. 22, 2009

(51) Int. Cl.
*B65D 41/14* (2006.01)
*B65D 41/12* (2006.01)

(52) U.S. Cl. ..... 215/328; 215/324; 215/327

(58) Field of Classification Search ..... 215/328, 215/324, 326
See application file for complete search history.

(56) References Cited

U.S. PATENT DOCUMENTS

| | | | | | |
|---|---|---|---|---|---|
| 1,433,552 | A | * | 10/1922 | Kalkbrenner | 215/328 |
| 1,722,587 | A | | 7/1929 | McDonnell | |
| 1,860,603 | A | * | 5/1932 | Allen | 417/44.4 |
| 2,048,062 | A | | 7/1936 | Elder | |
| D132,771 | S | | 6/1942 | Hutaff, Jr. | |
| 2,706,572 | A | | 4/1955 | Tocco | |
| 2,750,910 | A | | 6/1956 | Hammond, Jr. | |
| 3,092,280 | A | | 6/1963 | Ford | |
| 3,147,875 | A | * | 9/1964 | Rutledge, Sr. | 215/328 |
| 3,200,982 | A | | 8/1965 | Cormier | |
| 3,346,134 | A | | 10/1967 | Leemann | |
| 3,382,997 | A | | 5/1968 | Tsuji | |
| 3,410,435 | A | | 11/1968 | Kopczynski | |
| 3,514,004 | A | | 5/1970 | Hammersmith | |
| 3,606,062 | A | | 9/1971 | Frisch et al. | |
| 3,648,874 | A | | 3/1972 | Moller | |
| 3,774,795 | A | | 11/1973 | Leenaards | |
| 4,055,266 | A | | 10/1977 | Amabili | |
| 4,337,871 | A | | 7/1982 | Tucker | |
| 4,627,548 | A | * | 12/1986 | Thompson | 215/295 |
| 4,896,781 | A | | 1/1990 | Simard | |
| 5,458,253 | A | | 10/1995 | Shapcott | |
| 5,582,309 | A | * | 12/1996 | Bruhn | 215/301 |
| 6,006,933 | A | * | 12/1999 | Henning et al. | 215/328 |
| 6,109,465 | A | | 8/2000 | Henning | |
| 6,164,472 | A | | 12/2000 | Folchini | |
| D495,255 | S | | 8/2004 | Lewis | |
| D516,426 | S | | 3/2006 | Golding | |
| 2005/0029218 | A1 | | 2/2005 | Golding | |
| 2005/0067367 | A1 | * | 3/2005 | Carballido | 215/324 |
| 2005/0199576 | A1 | | 9/2005 | Sanchez | |

FOREIGN PATENT DOCUMENTS

| | | |
|---|---|---|
| GB | 1263571 | 2/1972 |

* cited by examiner

*Primary Examiner* — Mickey Yu
*Assistant Examiner* — Niki Eloshway
(74) *Attorney, Agent, or Firm* — Woodcock Washburn LLP

(57) ABSTRACT

A bottle sealed with a crown cap that has a soft feel during removal of the crown cap from the bottle is provided. Such a bottle may include a body and a neck extending up from the body. The neck may include a threaded portion, and a crimped crown cap may be removeably affixed onto the threaded portion. The crimped crown cap may include a circular top member, and a skirt depending downwardly from a periphery of the top member. The skirt may include alternating flutes and lands that are configured such that recesses are formed in a majority of the flutes. Preferably a majority of the recesses contact the threaded portion of the bottle neck. Because of the recesses formed in the flutes, the crown cap may have a soft feel during removal of the crown cap from the bottle.

11 Claims, 8 Drawing Sheets

TWIST OFF CROWN

FIELD OF THE TECHNOLOGY

The technology relates to closures for containers, and more particularly to a fluted crown cap for sealing a bottle opening.

BACKGROUND

Crown caps are well known for sealing bottle openings. Conventional crown cap configurations include a circular top, a circular skirt depending downwardly from a periphery of the top, and a downwardly and radially outwardly extending flange extending from a periphery of the skirt. The skirt generally has flutes or serrations formed therein to enhance capping and gripping on a bottle finish.

Crown caps, originally developed for opening by deforming upon actuation by a lever opener, are often configured for twisting off by employing threads formed on the finish of the bottle. Such twisting, in some circumstances, requires a relative high amount of opening torque and may be difficult to open or uncomfortable with respect to a user's hand.

For example, a beverage bottle sealed with a twist off crown cap often times is stored in ice water. As a result of being stored in the ice water, the amount of torque required to twist the crown off of the bottle may increase. Therefore, when an individual goes to twist the crown off, he or she may have to twist the crown harder thereby increasing the discomfort in their hand.

There is a general need for improved crown caps.

SUMMARY

A crown cap that has a softer feel compared to traditional twist-off crown caps is achieved. Because crowns have to be a certain size, manufacturers are limited in space, and creating a crown cap geometry that has a soft feel during twist off of the crown cap within that limited space has not been a straightforward engineering matter. In particular, creating a crown cap geometry that has a soft feel and also creates an adequate seal required the inventors to pursue several variations and experiments to achieve a crown cap that provides such features.

Accordingly, a soft feel crown cap for sealing onto a bottle is provided. Such a crown cap may include a circular top member, a skirt depending downwardly from a periphery of the top member, and a flange extending from the periphery of the skirt. The flange may include plural, substantially radially oriented, circumferentially spaced apart, upwardly extending flutes formed therein and land portions disposed between each flute. Each flute includes a crest and opposing sidewalls that are substantially flat. Further, each flute has a maximum width that is greater than a maximum width of each land.

A forming die for forming the soft feel crown cap is also provided. Such a forming die may include a locating diameter and a forming portion extending from the locating diameter. The locating diameter and forming portion may define a cylinder having an aperture extending therethrough. The forming portion may include alternating notch portions and nose portions, wherein each notch portion has a greater maximum width than a maximum width of each nose portion.

After the crown cap is made it may be sealed onto a bottle. For example, a crown cap having a circular top member, a skirt depending downwardly from a periphery of the top member, and a flange including alternating flutes and lands extending from a periphery of the skirt may be placed over the opening of a neck of a bottle. When the crown cap is sealed onto the bottle neck, recesses may be formed in a majority of the flutes such that a majority of the recesses contact a threaded portion of the bottle neck. Such a crown cap may have a softer feel during removal of the cap from the bottle.

Accordingly, a bottle sealed with a crown cap that has a soft feel during removal of the crown cap from the bottle is also provided. Such a bottle may include a body and a neck extending up from the body. The neck may include a threaded portion, and a crimped crown cap may be removeably affixed onto the threaded portion. The crimped crown cap may include a circular top member, and a skirt depending downwardly from a periphery of the top member. The skirt may include alternating flutes and lands that are configured such that recesses are formed in a majority of the flutes. Preferably a majority of the recesses contact the threaded portion of the bottle neck. Because of the recesses formed in the flutes, the crown cap may have a soft feel during removal of the crown cap from the bottle.

DETAILED DESCRIPTION OF ILLUSTRATIVE EMBODIMENTS

Preferred structures and methods for employing twist-off crown cap technology are described herein. Forming dies for producing twist-off crown caps that employ this technology are also described. The present invention is not limited to any particular twist-off crown cap but rather encompasses use in any crown cap.

Figure 1A:
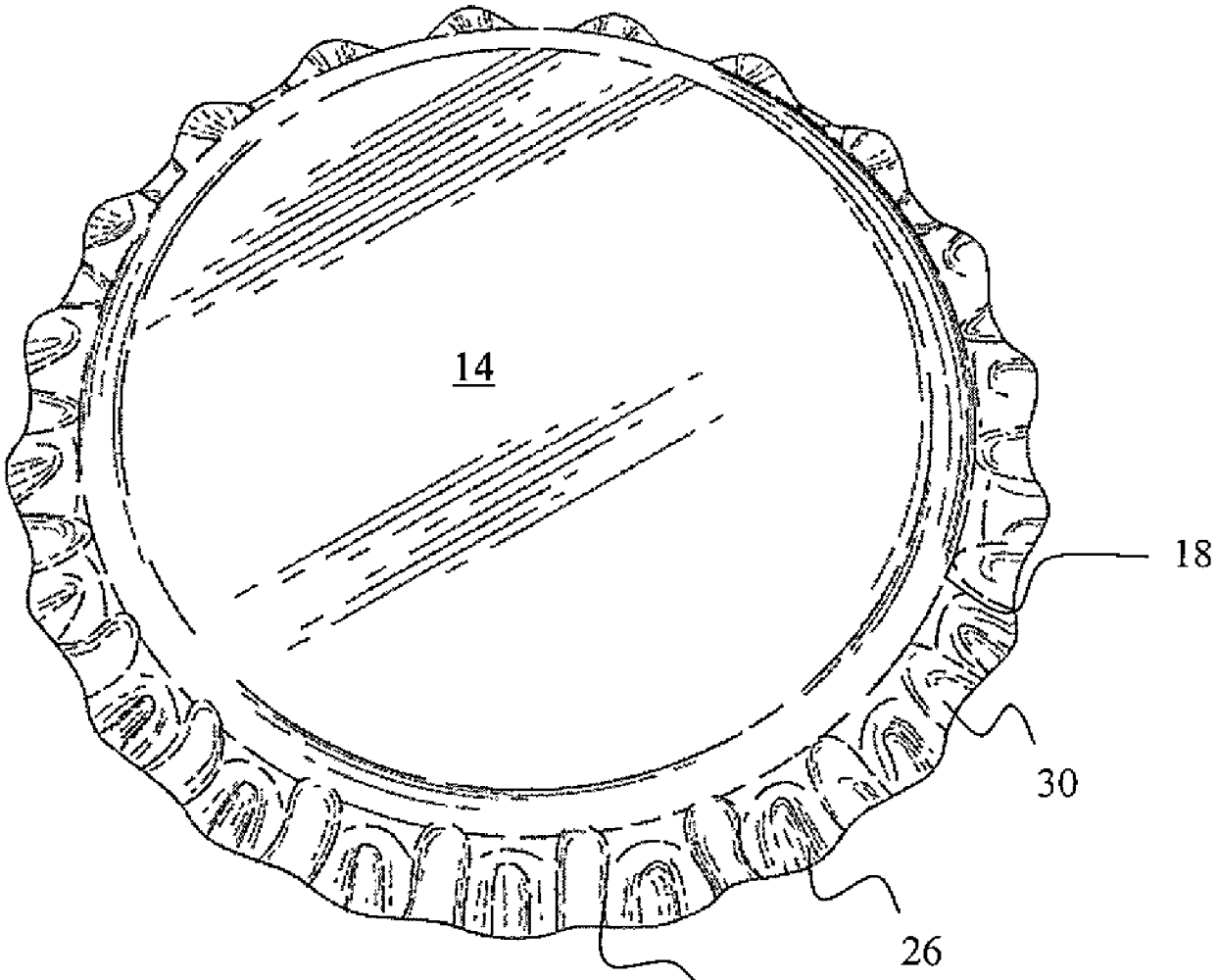
FIG. 1A is an isometric view depicting a crown cap in accordance with the present invention.
Figure 1B:
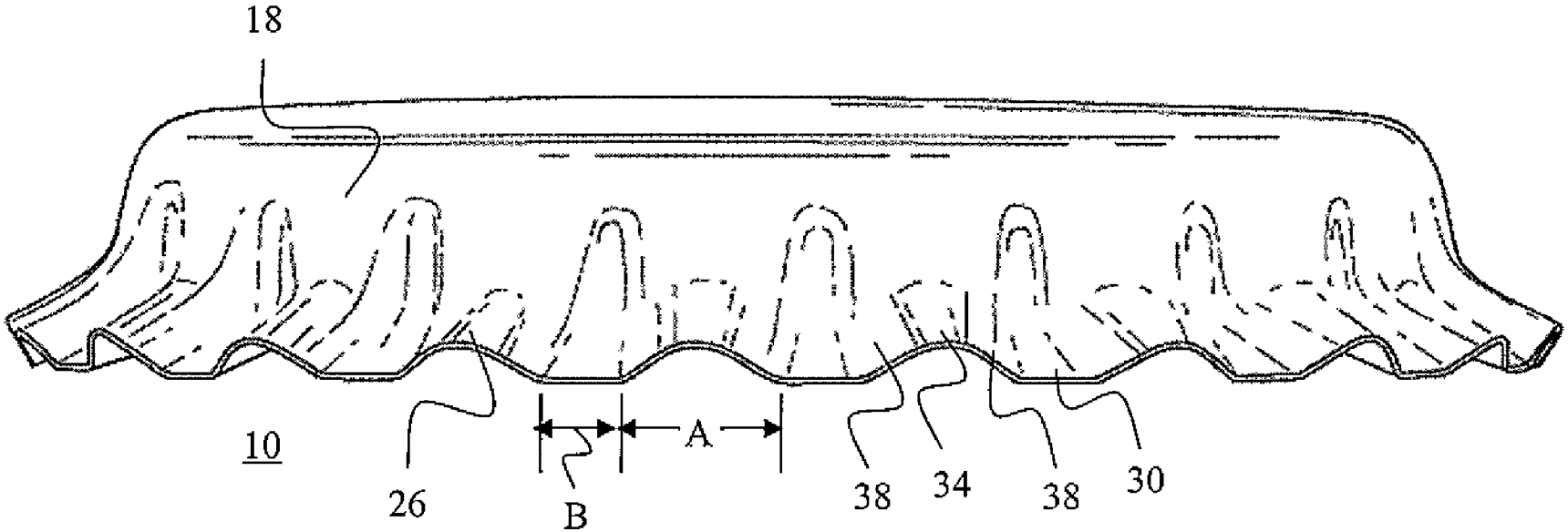
FIG. 1B is a side view of the crown cap depicted in FIG. 1A.

A crown cap 10, as illustrated in FIGS. 1A and 1B, includes a substantially circular top member 14 about which a circumferential skirt 18 downwardly depends. As shown, skirt 18 smoothly merges into a downwardly and radially outwardly extending flange 22. The flange 22 is divided into undulating, repeating portions including flutes 26 and lands 30. Preferably, the repeating portions are circumferentially evenly spaced apart such that each flute 26 is identical to all other flutes around the circumference of crown cap 10, and each land 30 is identical to all other lands around the circumference of crown cap 10. While, the crown cap 10 is shown as having twenty one flutes 26 and lands 30, it should be understood that the crown cap 10 may include any number of flutes 26 and lands 30. For example, crown cap 10 may include twenty seven flutes 26 and lands 30.

As shown in FIG. 1B, each flute 26 includes a crest 34 that is formed by a pair of opposing flute sidewalls 38. As shown, each sidewall 38 is substantially flat, and a lowermost portion of each flute sidewall 38 preferably smoothly merges with a land 30. As shown, each flute 26 may have a width of A mm and each land 30 may have a width of B mm. Preferably, the width A of each flute 26 is greater than the width B of each land 30. When the crown cap 10 is crimped onto a bottle neck, the wider flutes 26 may fold and create recesses in the crests 34 of the flutes. Such a crimped crown cap may create a softer feel to a consumer during twist off of the crown cap 10.

Figure 2:
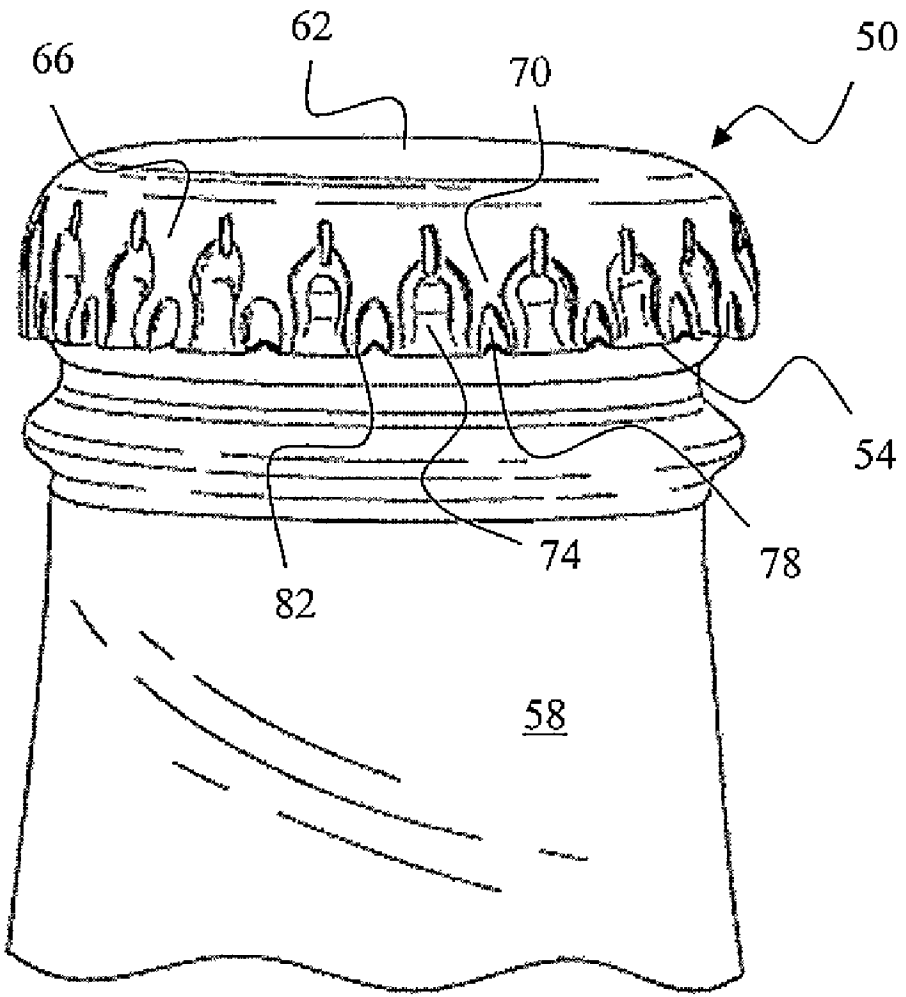
FIG. 2 is an isometric view depicting a crown cap sealed onto a bottle neck.

FIG. 2 depicts a crown cap crimped onto a bottle neck of a bottle. As shown, a crown cap 50 may be crimped onto a threaded portion 54 of a bottle neck 58. When the crown cap 50 is crimped onto the bottle neck 58, the flange (i.e. flange 22) of the crown cap is firmly pressed against the threads of the bottle neck, to securely hold the bottle cap onto the bottle. Accordingly, the crimped crown cap 50 includes a substantially circular top member 62 about which a circumferential skirt 66 downwardly depends. The skirt 66 includes alternating flutes 70 and lands 74. As shown, each flute 70 includes a recess 78. The recesses 78 may form groove-like channels that are open at a bottom edge 82 of the skirt 66. Preferably, at least a majority of the recesses 78 contact the threaded portion 54 of the neck 58.

Because of the recesses 78 that are formed in the flutes 70, a consumer will experience a softer feel during twist off of the crown cap 50. For example, when a consumer grabs and twists the crown cap 50, their hand may not experience the typical cutting feeling, as experienced with traditional twist-off crown caps, because the recesses 78 create a geometry in the crown-cap that minimizes such a cutting feeling. In this regard, recesses 78 are formed in a portion of the cap that, in commercial prior art caps, would tend to provide a relatively sharp gripping surface at their peripheries. Recess 78 tends to diminish the magnitude of sharp surfaces and/or provides greater surface area for gripping, compared with commercial prior art caps.

Furthermore, bottlers may not have to change their tooling to create the recesses 78 when a bottle cap is crimped onto a bottle. For example, if the crown cap has flutes that are wider than the lands, the flutes may fold during the crimping stage to thereby create the recesses 78. Such folding may occur using traditional tooling during the crimping stage. Therefore, bottlers may continue their standard operations to produce bottles sealed with a soft-feel twist off crown cap.

Figure 3A:
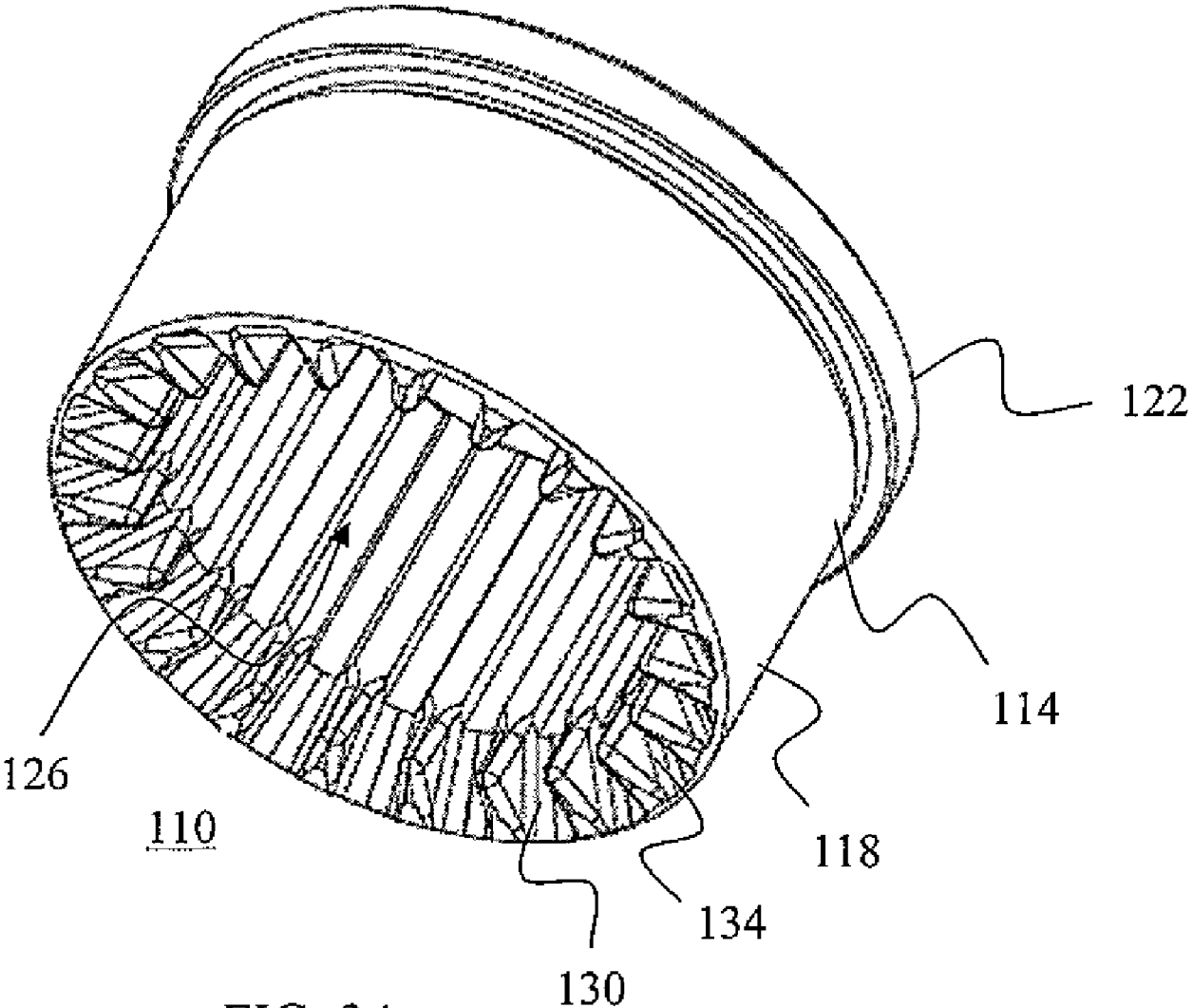
FIG. 3A is an isometric view depicting a tooling die for forming a crown cap in accordance with the present invention.
Figure 3B:
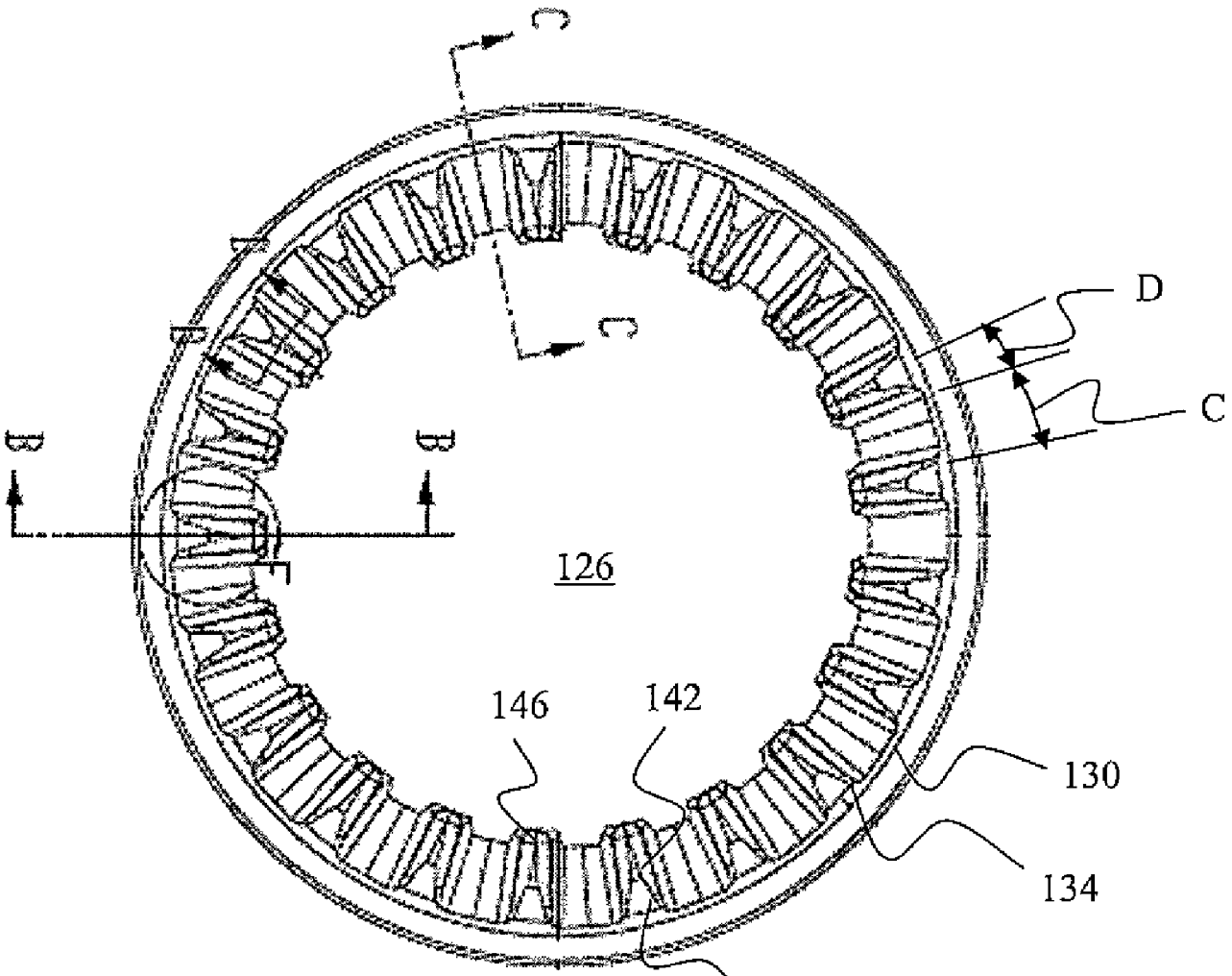
FIG. 3B is a top view of the tooling die depicted in FIG. 3A.

FIGS. 3A and 3B depict an example forming die that may be used to create a crown cap in accordance with the present invention. As shown, a forming die 110 includes a locating diameter 114, a forming portion 118 extending from the locating diameter 114, and a locating flange 122 extending around the locating diameter 114. The locating diameter 114 and forming portion 118 may define a cylinder having an aperture 126 extending therethrough. As shown in FIGS. 3A and 3B, the forming portion 118 includes alternating notch portions 130 and nose portions 134. Preferably, the alternating portions are circumferentially evenly spaced apart such that each notch portion 130 is identical to all other notch portions of the forming portion 118, and each nose portion 134 is identical to all other nose portions of the forming portion 118. While, the forming die 110 is shown as having twenty one notch portions 130 and nose portions 134, it should be understood that the forming die 110 may include any number of notch portions 130 and nose portions 134. For example, forming die 110 may include twenty seven notch portions 130 and nose portions 134.

As shown in FIG. 3B, each notch portion 130 may have a maximum width of C and each nose portion 134 may have a maximum width of D, such that C is greater than D. For example, C may equal approximately 3.3 mm and D may equal approximately 1.85 mm. By having C greater than D, a crown cap having wider flutes than lands may be manufactured. As stated earlier, when such crown caps are crimped onto a bottle, recesses may be formed in the flutes to thereby create a crown cap having a soft feel during twist off of the crown cap from the bottle.

Figure 3D:
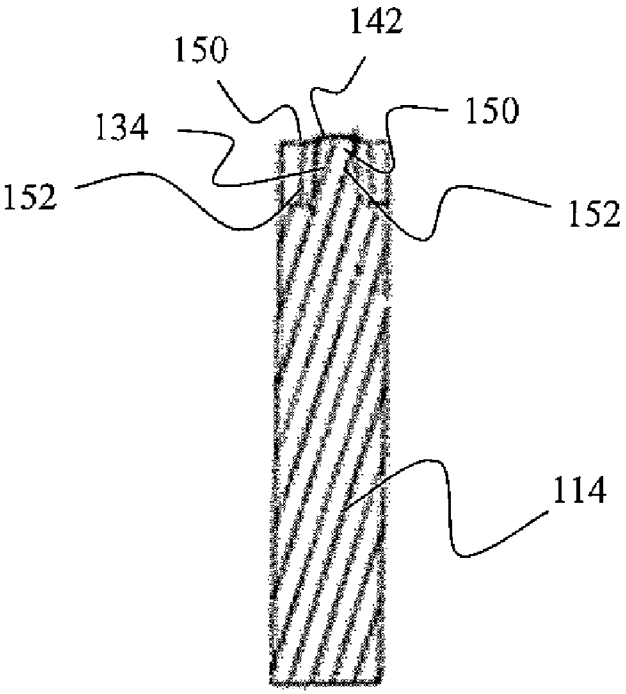
FIG. 3D is a cross-sectional view of the tooling die depicted in FIG. 3B through the line D-D.
Figure 3C:
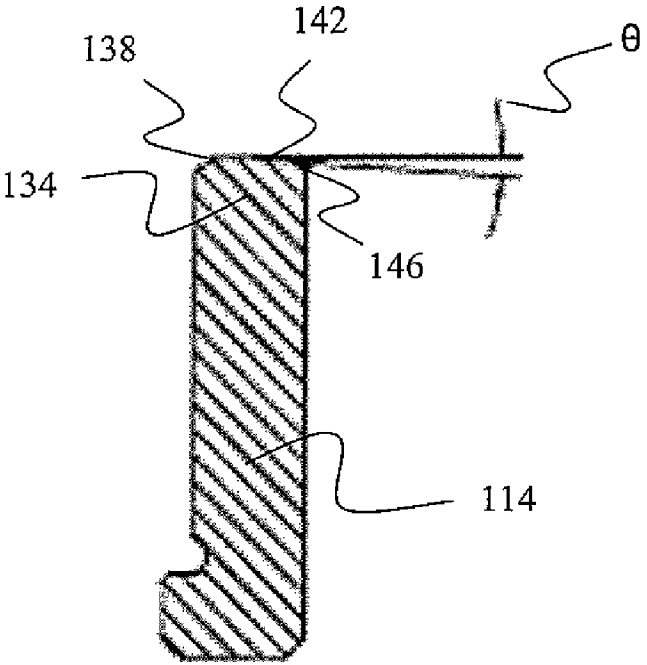
FIG. 3C is a cross-sectional view of the tooling die depicted in FIG. 3B through the line B-B.

FIG. 3C is a cross-sectional view through the line B-B of FIG. 3B depicting a cross-section of the nose portion 134. As shown in FIGS. 3B and 3C, each nose portion 134 may include a substantially flat portion 138 and a peak portion 142 extending from the flat portion 138. The peak portion 142 may extend toward the center of the forming die at an angle of θ degrees below the horizontal. Preferably, θ equals approximately 4 degrees below the horizontal. As shown, each nose portion 134 may also include a distal end 146. Preferably, each distal end 146 is rounded and has a radius of approximately 0.025±0.001 inches (0.635 mm).

FIG. 3D is a cross-sectional view through the line D-D of FIG. 3B depicting another cross section of the nose portion 134. As shown, each nose portion 134 extends up from the locating diameter 114, and includes side portions 150 extending from each side of the peak portions 142. The side portions 150 each terminate into a respective sidewall 152, and each sidewall 152 extends down and smoothly merges with a notch portion 130. Preferably, each side portion 142 is rounded and has a radius of approximately 0.024±0.001 inches (0.6096 mm).

Figure 3E:
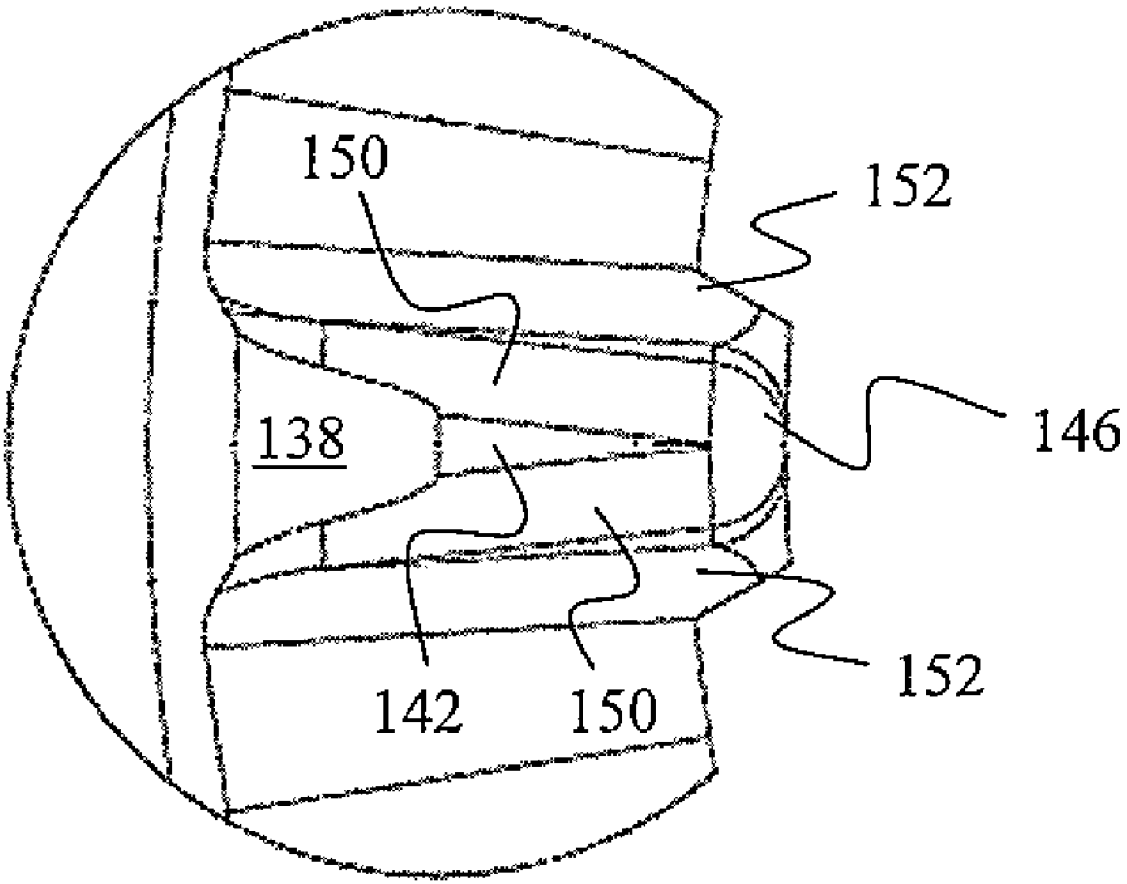
FIG. 3E is an enhanced view of section F depicted in FIG. 3B.

FIG. 3E is an enhanced view of section F shown in FIG. 3B depicting details of the nose portion 134. As shown, the peak portion 142 extends from the flat portion 138 and terminates at a point proximate to the distal end 146. The side portions 150 are rounded and extend down to the sidewalls 152.

Figure 3F:
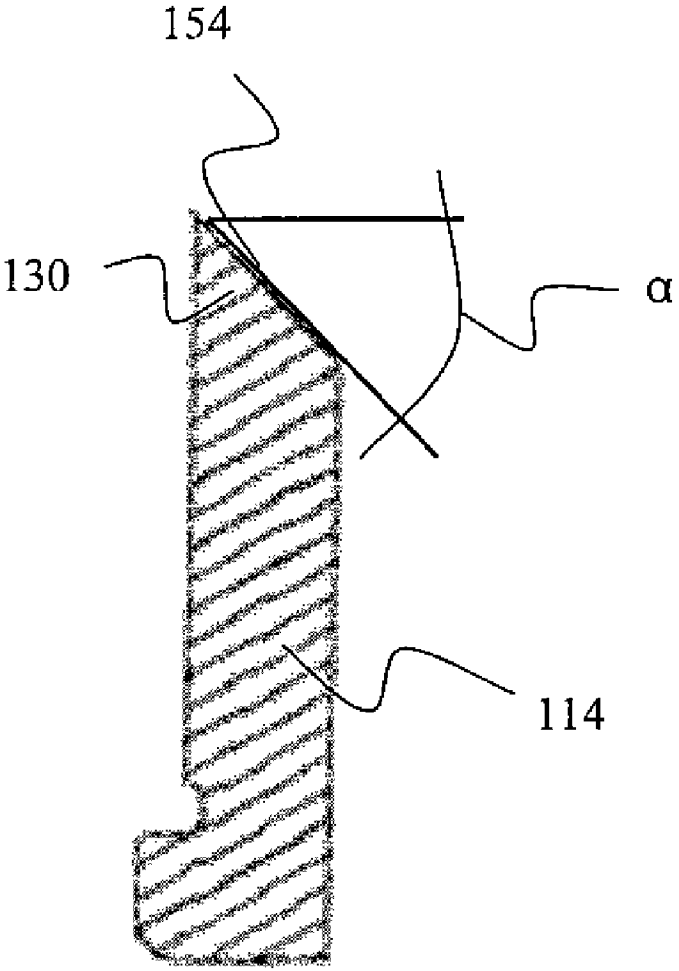
FIG. 3F is a cross-sectional view of the tooling die depicted in FIG. 3B through the line C-C.

FIG. 3F is a cross-sectional view through the line C-C of FIG. 3B depicting a cross-section of the notch portion 130. As shown, each notch portion 130 includes a surface 154 that extends toward the center of the forming die. As shown, the surface 154 may extend toward the center of the forming die at an angle α. While the surface 154 may extend toward the center of the forming die at an angle α that is between 20 and 70 degrees, it preferably extends at an angle of approximately 45 degrees.

What is claimed:

1. A bottle sealed with a twist-off crown cap comprising:

a bottle having a body and a neck extending up from the body, the neck including a threaded portion; and a crimped crown cap removeably affixed onto the threaded portion of the neck, the crown cap including a circular top member, and a skirt depending downwardly from a periphery of the top member, the skirt including alternating flutes and land portions, that are configured such that recesses are formed in a majority of the flutes, wherein the recesses of the crimped crown cap defined groove-like channels that are open at a bottom edge of the criped crown cap, and at least a majority of the recesses contact the threaded portion of the neck.

2. The bottle of claim 1, wherein the recesses of the crimped crown cap are formed at a peripheral edge of the flutes.

3. The bottle of claim 1, wherein the threaded portion includes at least two non-continuous threads.

4. The bottle of claim 1, wherein all of the recesses of the crimped crown cap contact the threaded portion of the neck.

5. A crown cap for applying to a beverage bottle, the crown cap comprising:

a circular top member;

a skirt depending downwardly from a periphery of the top member; and a flange extending from the periphery of the skirt, the flange having an edge that defines an outer circumference of the crown cap, the flange including plural, substantially radially oriented, circumferentially spaced apart, upwardly extending flutes formed therein and land portions disposed between each flute, wherein (i) each flute includes a crest and opposing sidewalls that are substantially flat, and (ii) a maximum width of each flute at the outer circumference is greater than a maximum width of each land at the outer circumference.

6. The crown cap of claim 5, wherein the flange includes 27 flutes and 27 lands.

7. The crown cap of claim 5, wherein the flange includes 21 flutes and 21 lands.

8. The crown cap of claim 5, wherein the flutes each have a maximum width such that the flutes are capable of folding and forming recesses when the crown cap is applied to a beverage bottle.

9. A method for capping a beverage container, the method comprising:

providing a bottle having a body, and a neck extending up from the body, wherein the neck includes an opening at an end thereof and a threaded portion;

placing a crown cap over the opening of the neck, the crown cap having a circular top member, a skirt depending downwardly from a periphery of the top member, and a flange extending from the periphery of the skirt, wherein the flange includes alternating flutes and lands; and sealing the crown cap onto the threaded portion of the neck, wherein recesses are formed in a majority of the flutes during sealing, such that a majority of the recesses contact the threaded portion of the neck.

10. The method of claim 9, wherein the recesses are formed at a peripheral edge of the flutes.

11. The method of claim 9, wherein the crown cap is crimped onto the threaded portion of the neck.

* * * * *